US006517472B1

(12) United States Patent
Starlinger Huemer et al.

(10) Patent No.: US 6,517,472 B1
(45) Date of Patent: Feb. 11, 2003

(54) DEVICE FOR SEPARATING MATERIAL WEBS LYING ON TOP OF EACH OTHER

(75) Inventors: Franz Starlinger Huemer, Vienna (AT); Gerhard Apfler, Vienna (AT)

(73) Assignee: Starlinger & Co. Gesellschaft m.b.H., Vienna (AT)

( * ) Notice: Subject to any disclaimer, the term of this patent is extended or adjusted under 35 U.S.C. 154(b) by 0 days.

(21) Appl. No.: 09/555,721

(22) PCT Filed: Oct. 4, 1999

(86) PCT No.: PCT/AT99/00236

§ 371 (c)(1),
(2), (4) Date: Jun. 1, 2000

(87) PCT Pub. No.: WO00/20193

PCT Pub. Date: Apr. 13, 2000

(30) Foreign Application Priority Data

Oct. 5, 1998 (AT) ..... 1658/98

(51) Int. Cl.[7] ..... B31B 1/12

(52) U.S. Cl. ..... 493/123; 493/308; 493/313; 493/315; 493/316; 493/317; 493/256

(58) Field of Search ..... 493/308, 309, 493/313, 315, 316, 317, 256

(56) References Cited

U.S. PATENT DOCUMENTS 2,224,646 A * 12/1940 Robinsion ..... 209/583
3,446,121 A * 5/1969 Achelpohl ..... 29/421.1
5,398,486 A * 3/1995 Kauss et al. ..... 493/189
5,827,165 A * 10/1998 Achelpohl et al. ..... 493/256

* cited by examiner

*Primary Examiner*—Rinaldi I. Rada
*Assistant Examiner*—Hemant M Desai
(74) *Attorney, Agent, or Firm*—Townsend and Townsend and Crew LLP

(57) ABSTRACT

A device for separating two webs of material which are arranged on top of each other. The webs of material are to be separated while they are being transported on a conveying device, the first of the webs of material being detachably fixed to the conveying device. The device includes a suction device which is moveable in relation to the second web of material and by which means it is able to temporarily draw the second web of material by suction and separate it from the first web of material. Two cranks are set apart, each crank rotates about a first pivot pin and is rotationally connected to the suction device by a second pivot pin. A drive device with an engaging element is connected to an engaging element configured on one of the cranks. The paths of revolution of the drive device engaging element and the crank engaging element do not coincide and are nonparallel, and the engaging elements engage with each other in such a way that they can be displaced in relation to each other.

14 Claims, 6 Drawing Sheets

DEVICE FOR SEPARATING MATERIAL WEBS LYING ON TOP OF EACH OTHER

BACKGROUND OF THE INVENTION

The present invention relates to a device for separating two webs of material lying on top of each other, in particular those of bag bodies or individual portions thereof, while they are being transported on a conveying means, the first of the material webs being detachably fixed to the conveying means, the device comprising:

a suction means movable with respect to the second material web, in order to temporarily suck the second material web and separate it from the first material web, two cranks spaced from each other, having a respective first rotatable joint for rotating the crank around this rotatable joint, as well as a respective second rotatable joint, to which the suction means is connected so as to be rotatable, both cranks having the same distance between their respective first and second rotatable joints, and the distance between the first rotatable joints of both cranks being equal to the distance of the second rotatable joints of both cranks when they are connected to the suction means, so that the rotatable joints define the corners of a parallelogram.

Generally the process for manufacturing bags of any kind of material comprises a step wherein the pre-cut tubular bag bodies are folded at one end so as to form a bottom. For this purpose a slide is inserted into an open end between the walls of the flat bag body; movement of the slide, optionally cooperating with bars disposed outside the bag body, results in the desired folding of the side walls of the bag body. As the bag bodies are transported towards the slide in a state wherein they are lying flat on top of each other, there is a problem in that the seams of the open ends of the bag body or even complete border regions thereof may adhere to each other, and thus the slide cannot be inserted between the bag body walls. This effect may be caused by electrostatic charging of the material webs; by the presence of adhesive residues; in the case of plastic materials, by welding of the bag body seams in the course of cutting of the bag body by means of a hot wire; or in the case of airtight materials in general, by contiguity of areas of the material. In any case the adherence of the seams of the ends of the sack bodies makes it necessary to provide a production step wherein the end regions of the material webs are separated from each other, so as to subsequently be able to insert the slide between the material webs. Furthermore, it is desirable to carry out this separation process while continuously transporting the bag bodies so as not to decrease the production speed. Additionally, all movable parts of the device involved in the separation process are to be moving continuously, i.e. with as little acceleration and deceleration as possible, so as to avoid premature wear and the necessity of high driving energy. From the point of view of wear and energy consumption of the device, uniformly rotating parts would be ideal.

The problems mentioned may be overcome by means of various devices, for instance a device known from German Patent Application No. 1,511,021. This device has a suction bar rotating with the machine timing. The suction bar is pivotably connected to levers by means of two pins, which levers are in their turn non-rotatably connected to gearwheels by pins disposed on the latter. The gearwheels engage a further rotatable gearwheel that transmits a driving force to the former gearwheels. Thus the suction bar moves parallel to the direction of transport of hose portions. In order to linearize the speed of the suction bar, it is proposed to drive the driving gearwheel in its turn by an elliptical wheel gear. Another driving means is neither disclosed nor suggested.

A disadvantage of the device disclosed in German Patent Application No. 1,511,021 is the use of an elliptical wheel gear, which is expensive to produce, on the one hand, and which does not enable complete linearization of the suction bar movement synchronously with the movement of the bag bodies, on the other hand, but only an approximation thereof. The closer the approximation to a linearly uniform suction bar movement, i.e. the more pronounced the gearwheel ellipses, the higher the inevitable friction losses, too.

SUMMARY OF THE INVENTION

The present invention offers a solution to the disadvantages of the prior art that enables complete linearization of the suction bar movement synchronously with the movement of the bag bodies, while being highly economical.

Thus according to the invention a device for separating webs of material is provided with a drive means having an engagement element orbiting along a predetermined path and connected to an engagement element formed at one of the cranks, the orbits of the engagement element of the drive means and of the engagement element of the crank not coinciding and not being parallel, and the engagement elements engaging each other displaceably with respect to each other.

By means of the rotatable connection of the suction means with the two cranks, the rotatable joints involved forming a parallelogram, the suction means carries out a rotational movement in the course of which it approaches or contacts the second material web and sucks it, subsequently moving back again, the sucked second material web being pulled along, thus rising from the first material web. The rotational movement of the suction means is advantageous in that it has a velocity component parallel to the conveying direction of the material webs so as to guide along the suction means with the movement of the material webs in the course of the separation process, as well as a velocity component at right angles to the conveying device in order to pull the second material web away from the first one. However, in the case of uniform rotational movement, the course of both velocity components would be sinusoidal, so that the parallel velocity component of the suction means would be the same as the conveying speed of the material webs only at a certain crank angle. As a consequence, the second material web would be not only lifted from the first one, but also displaced, which would have negative consequences during subsequent processing steps of the material webs. Thus it is necessary to linearize the course of the parallel velocity component of the suction device. According to the invention, this is achieved by providing an engagement element of the driving means and an engagement element of the crank that move along paths not identical with each other, it being possible to match the parallel velocity of the suction means with the conveying speed of the material webs for a large range of crank angles by choosing the orbit paths of the engagement elements and the speed of the driving means accordingly.

With embodiments of the invention, the cranks may be formed as crank disks or with crank arms.

In order to make room for the displacements the engagement elements experience with respect to each other while orbiting, according to the invention either the engagement element of the drive means or the engagement element of the crank may be formed with a cam engaging a slot or an oblong hole or a channel in the other engagement element. Alternatively, it is also possible to provide a telescopic arm, which is articulated to the driving means and the crank.

Preferably, the suction means communicates with a vacuum source. But as the suction means only has to operate during part of its revolution, it is advantageous in this case for the communication to be interruptable depending on the angular position of one of the cranks connected to the suction means.

A convenient embodiment of a device according to the invention is characterized in that a supply pipe of the suction means is vacuum-tightly connected to a through hole in a disk, the disk being rotatable together with one of the cranks, and a stationary vacuum bar connected to the vacuum source is substantially vacuum-tightly contiguous with the opposite surface of the disk, the vacuum bar having a mouth opening taking the form of a circular arc and facing towards the disk surface, which opening coincides with the circular path described by the mouth of the through hole when the disk is rotated. In this embodiment a crank disk may serve as said disk.

A preferable embodiment of the suction means comprises a bar having an internal channel for connecting to a vacuum source and a plurality of exit openings extending from the internal channel, to which suction cups are conveniently attached.

Basically it is sufficient to drive only one of the cranks, the one to which the suction means is connected, as the driving torque is transmitted to the second crank by the suction means. It may, however, be the case that the cranks have to be set in motion from a dead center, this dead center being the crank position where the sides of the parallelogram formed by the joints of the crank coincide to form a line. In this position it is very unlikely that the cranks may be set in motion. In order to avoid this, it is advantageous to connect the two cranks for synchronous movement by means of a belt or chain gear.

The driving means with the engagement element provided thereon may be formed in different ways. According to a first embodiment the engagement element is attached to a chain or a belt encircling at least two wheels, at least one of which is driven. The chain or belt defines an orbit path of the engagement element of the driving means. Preferably the chain or belt has a run parallel to the conveying direction of the material webs, and the speed of the chain or belt is the same as the conveying speed of the material webs. Thus it is possible to achieve complete linearization of the velocity component parallel to the conveying direction of the material webs as long as the engagement element moves in the parallel run. Favorably the engagement element has a channel at right angles with the chain or belt, wherein a cam or roller engages as the engagement element of a crank.

A further embodiment of the invention is characterized in that the drive means comprises a driven disk, the rotational axis of which is offset with respect to the rotational axis of the crank it engages. The eccentricity of the driven disk and the crank connected therewith by way of engagement elements achieves the desired linearization of the parallel velocity of the suction means.

The invention will now be described in more detail by way of examples.

DESCRIPTION OF THE PREFERRED EMBODIMENTS

Figures 1, 2:
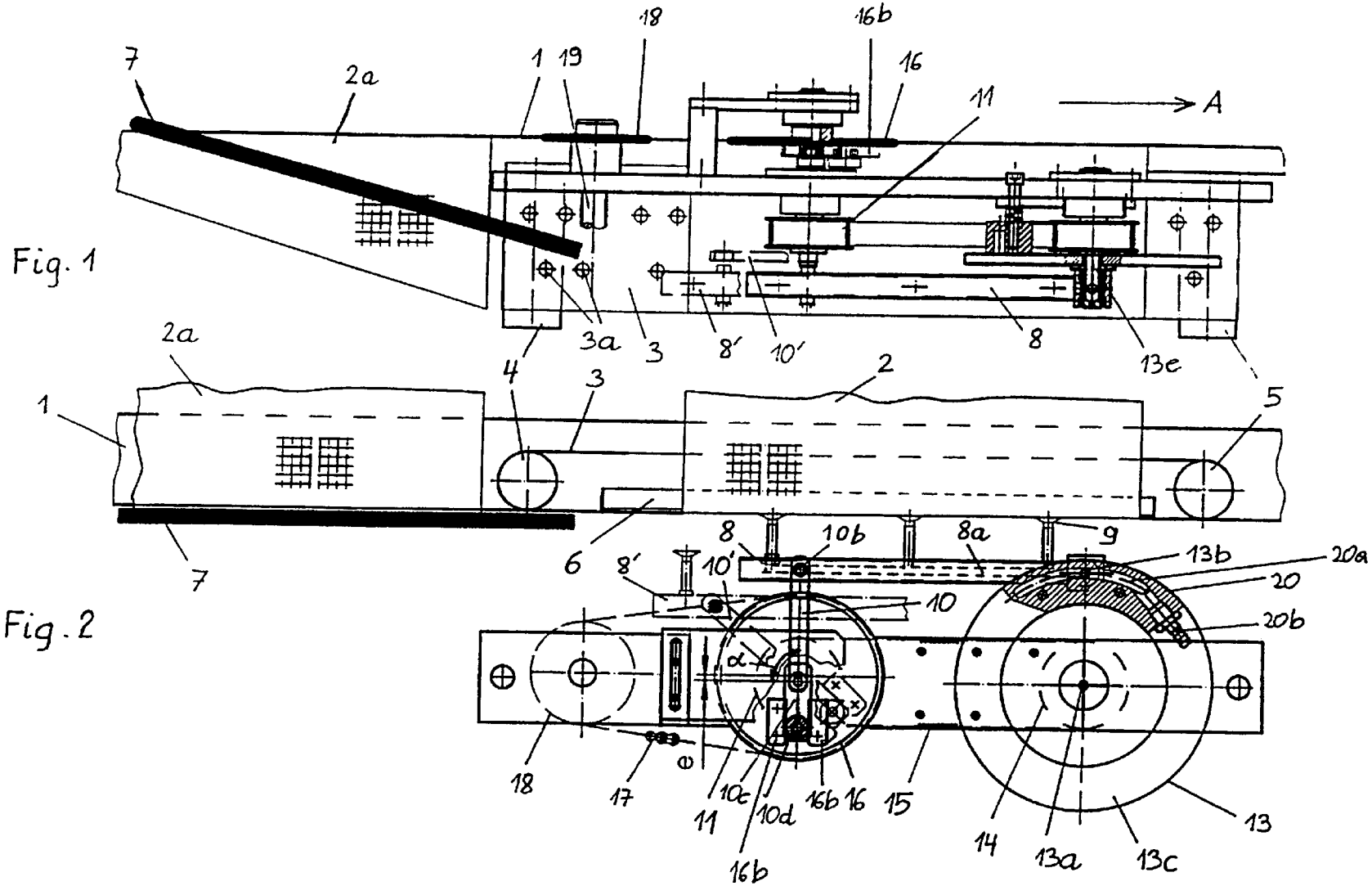
FIG. 1 schematically shows a first embodiment of the device according to the invention in side view.
FIG. 2 shows the same device in plan view.

First referring to FIGS. 1 and 2, there is shown a conveying means taking the form of a conveyor belt 1 moving in the direction of arrow A. Tubular bag bodies 2*a*, 2*a* are arranged on the conveyor belt with their longitudinal axes oriented transversely to the conveying direction A, the major portion of the bag body lying horizontally on the conveyor belt, and only one end portion, the material webs of which are to be separated, being suspended from the longitudinal edge of conveyor belt 1. The conveying means further has a second conveyor belt 3 arranged vertically below conveyor belt 1 and oriented along the longitudinal edge thereof, which turns around rollers 4, 5 at the same speed as conveyor belt 1. Conveyor belt 3 takes the form of a perforated conveyor belt having a plurality of holes 3*a*, a vacuum bar 6 being arranged behind it, so that the material web of bag body 2 facing towards conveyor belt 3 is sucked against the surface of conveyor belt 3 along the length of vacuum bar 6 and is fixed thereto during the belt's continuous transport. In order to ensure that this first material web of the bag body is in fact sucked by conveyor belt 3, a downwardly inclined guiding rod 7 is provided, which guides the respective suspended portion of the bag bodies 2*a* towards conveyor belt 3.

A suction means as provided for by the invention is arranged on that side of the bag body portions suspended from conveyor belt 1 facing away from conveyor belt 3. This suction means comprises a bar 8 arranged in parallel with the suspended portion of the bag bodies, where a series of suction cups 9 are fixed to that side of the bar facing towards the bag body. The suction cups communicate with a vacuum channel 8*a* inside bar 8, the vacuum channel 8*a* being indirectly connected to a vacuum source (not shown). On the one hand, the bar 8 is connected to a crank arm 10 rotating around a pivot bearing 10*a*, by means of a rotatable joint 10*b*, and further connected to a crank disk 13 rotating around a pivot bearing 13*a*, by means of a rotatable joint 13*b*.

Coaxially with the axis of rotatable joint 10*a*, a pulley 11 is rigidly connected to the crank arm 10. Another pulley 14 is connected to crank disk 13 coaxially and rigidly. The two pulleys 11 and 14 are of equal diameter and are coupled to each other by means of a belt 15. This belt gear serves the purpose of synchronously moving the two cranks 10, 13 and of avoiding the failure of crank 13 running along by connection to bar 8 to be set in motion by driven crank 10 in case the cranks accidentally stop at a dead center.

The cranks 10, 13 together with bar 8 fulfill the following dimensioning conditions: The rotatable joints 10*a*, 13*a*, around which crank arm 10 and crank disk 13, respectively, are rotating, have the same distance to each other as the rotating joints 10*b*, 13*b* when they are connected to bar 8; and the distance between the rotatable joints 10*a*, 10*b* of the crank arm is the same as the distance between the rotatable joints 13*a*, 13*b* of the crank disk 13. Thus these four rotatable joints form the corners of a parallelogram. This arrangement of cranks with bar 8 so as to form a parallelogram results in the bar always maintaining a position parallel to the material web while being rotated by driving one crank, the distance between the assembly and the material web being adjusted so that the suction cups 9 contact the material web when they come closest thereto.

Figure 3:
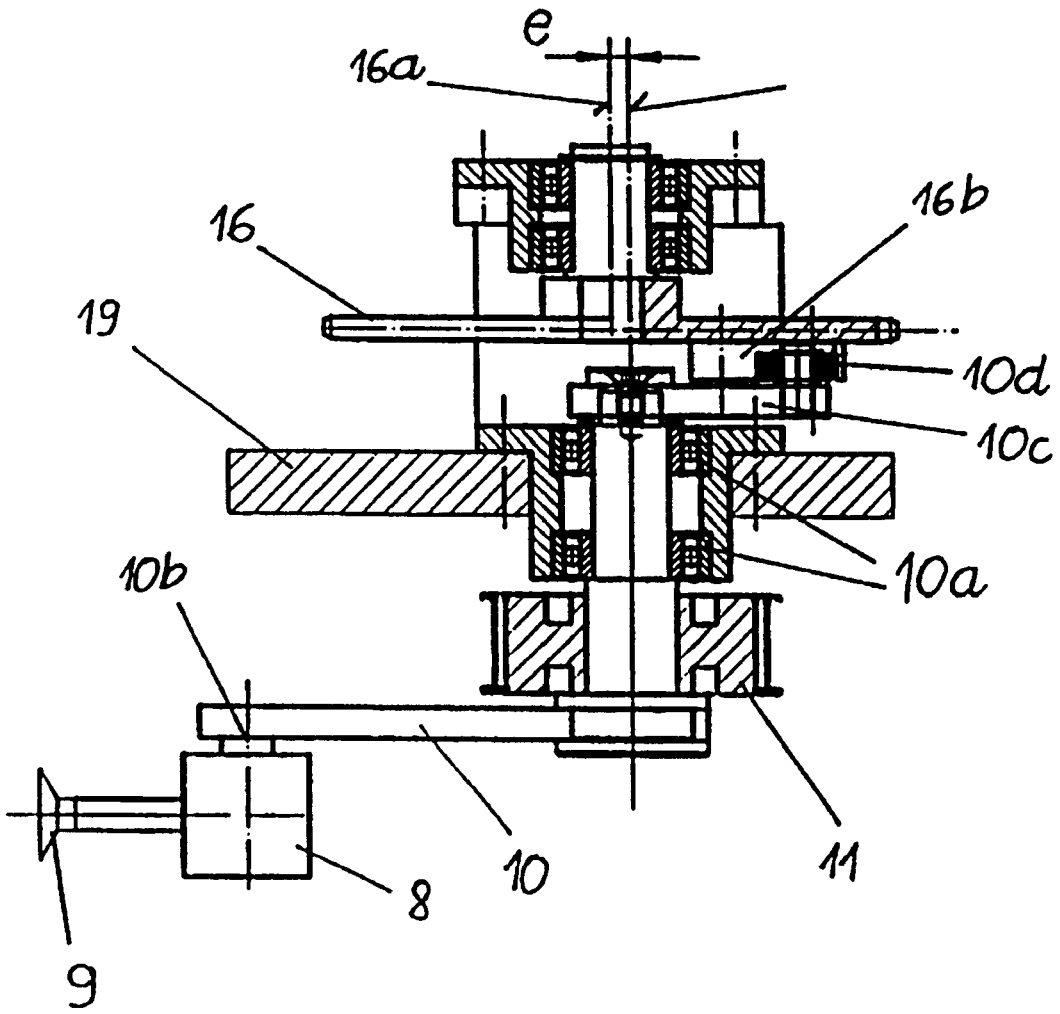
FIGS. 3 and 4 show details of the first embodiment of the inventive device.
Figure 4:
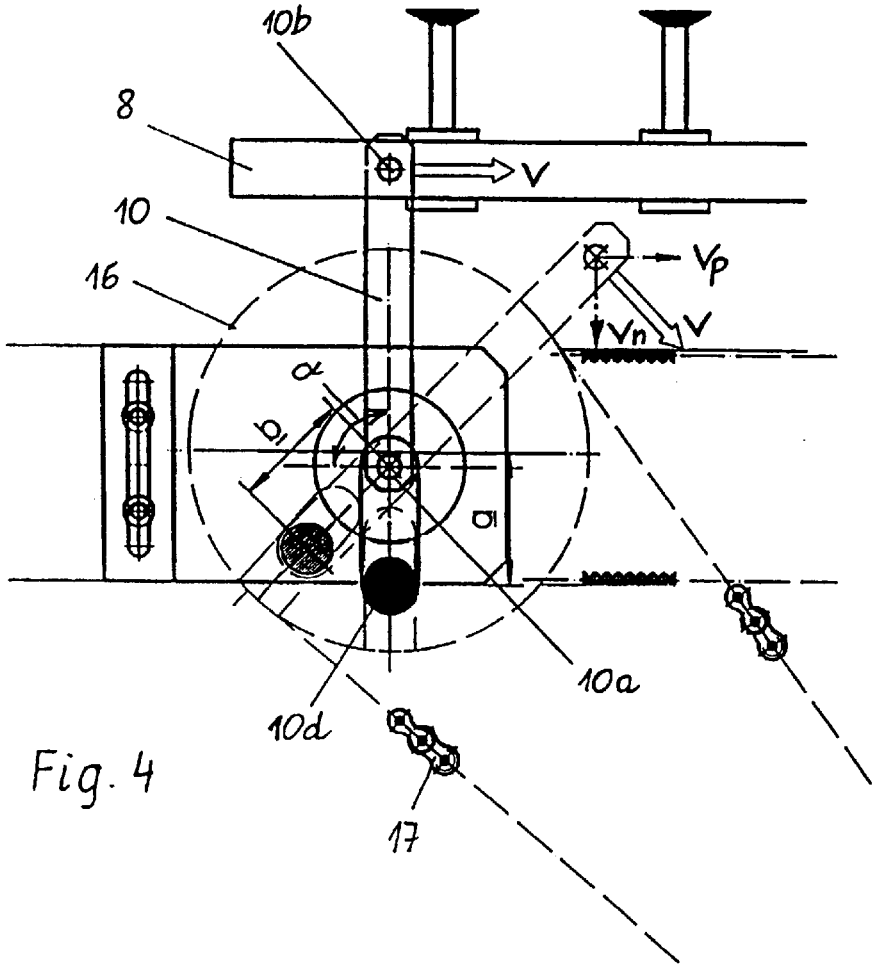

Now referring to FIG. 4, illustrating an enlarged detail of FIG. 2, there is shown the circular speed of rotatable joint 10*b* as vector v, which may be resolved in a velocity component vp parallel to the conveying direction of the material webs, and a velocity component vn at right angles to the conveying direction of the material webs. These velocity vectors also apply to bar 8. Both velocity components vp, vn would change sinusoidally in the case of uniform circular speed, i.e. in the case of uniform rotation of crank 10 around pivot bearing 10*a*. This is, however, undesirable, as mentioned above. Instead, the aim is to linearize as nearly as possible the parallel velocity component vp around the range of a crank angle a of 90°, that is, the range where bar 8 most closely approaches the material web. This is achieved by driving crank 10 by means of an eccentric element, as will be explained in the following with special reference to FIGS. 2 and 3.

A drive means taking the form of a crown gear 16 with a rotational axis 16*a*, which is axially parallel to the rotational axis of rotatable joint 10*a* of crank 10 but offset therefrom by an eccentric distance e, is coupled to a pinion 18, which is connected to the driving shaft 19 of a motor (not shown), via a chain 17. At its lower side, crown gear 16 has two guide plates 16*b* arranged approximately radially and in parallel with each other and defining a channel between them, which engages a cam or roller 10*d*. Roller 10*d* is arranged at the tip of a protrusion 10*c* of crank arm 10, protrusion 10*c* being the extension of crank arm 10 beyond pivot bearing 10*a*. As the rotational axes of crown gear 16 and crank 10 are offset from each other by a distance e, crank 10 is not moved uniformly in the case of uniform rotation of crown gear 16, but is accelerated and decelerated as a function of eccentricity e and distance b (see FIG. 4) from roller 10*d*, to pivot bearing 10*a*, roller 10*d* sliding in the channel between the guide: plates 16*b*, so as to compensate for the displacement of the point of engagement between the roller and the guide plates.

Figure 5:
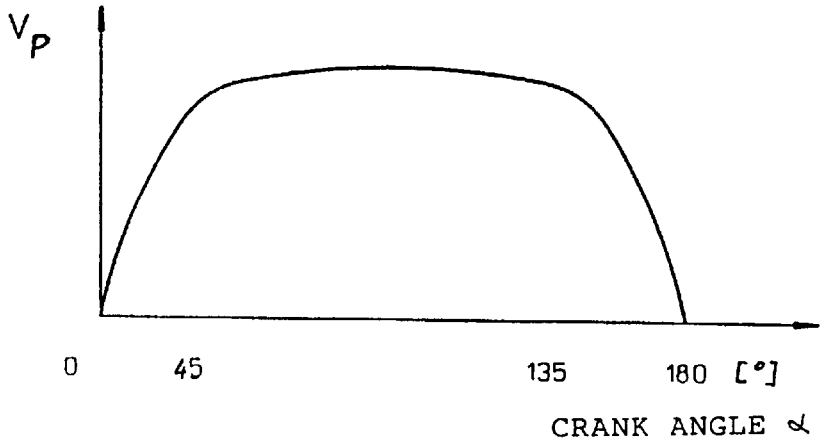
FIG. 5 is a graph of the course of the parallel velocity component of the rotating suction means of the inventive device versus the crank angle, FIG. 6 schematically shows a second embodiment of the device according to the invention in side view.
Figure 6:
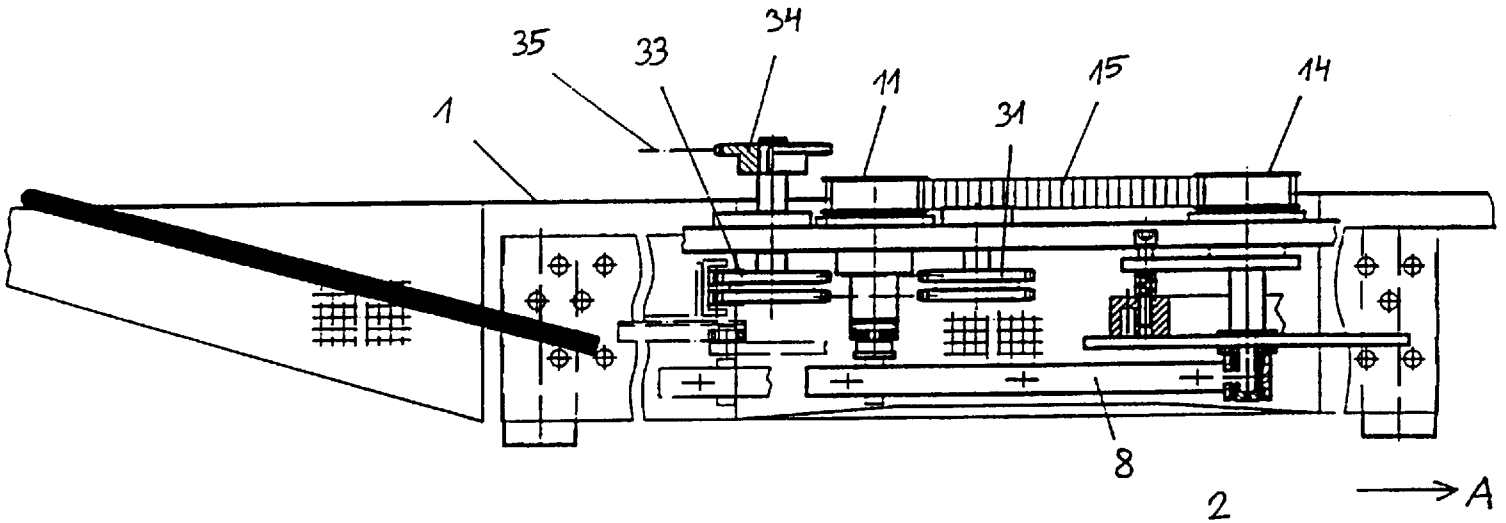
Figure 7:
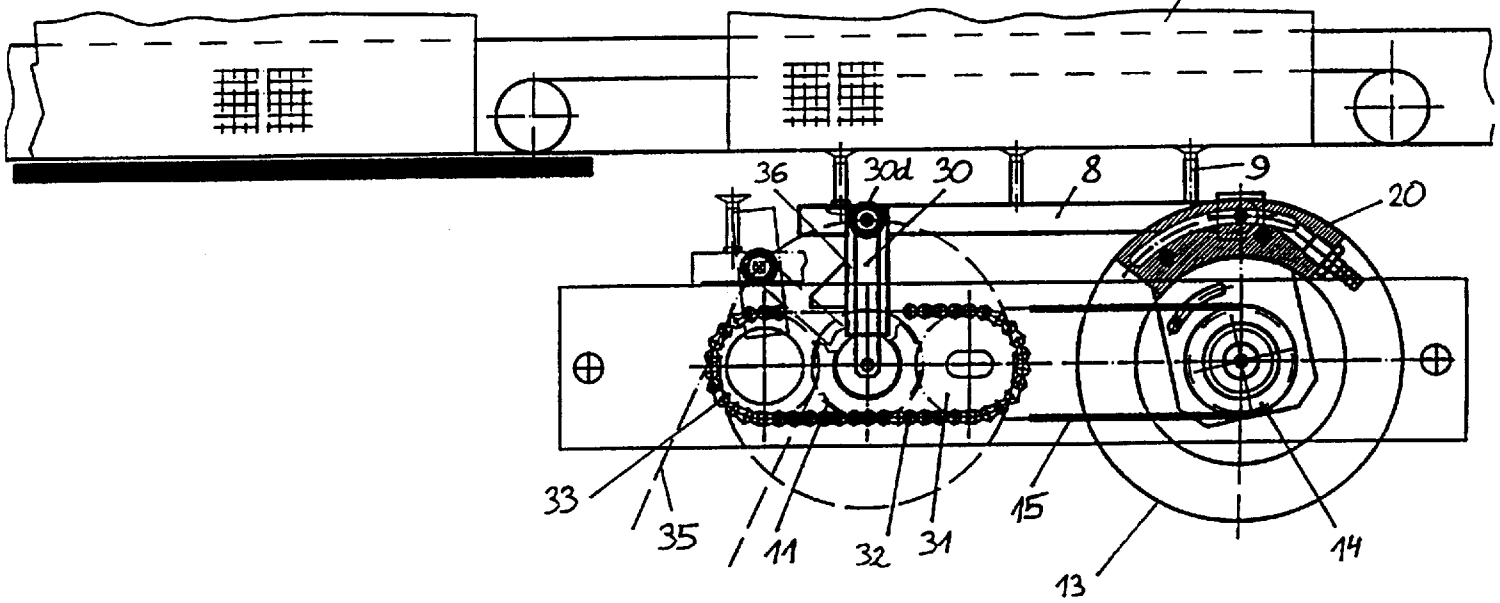
FIG. 7 is a plan view of the same device.
Figure 8:
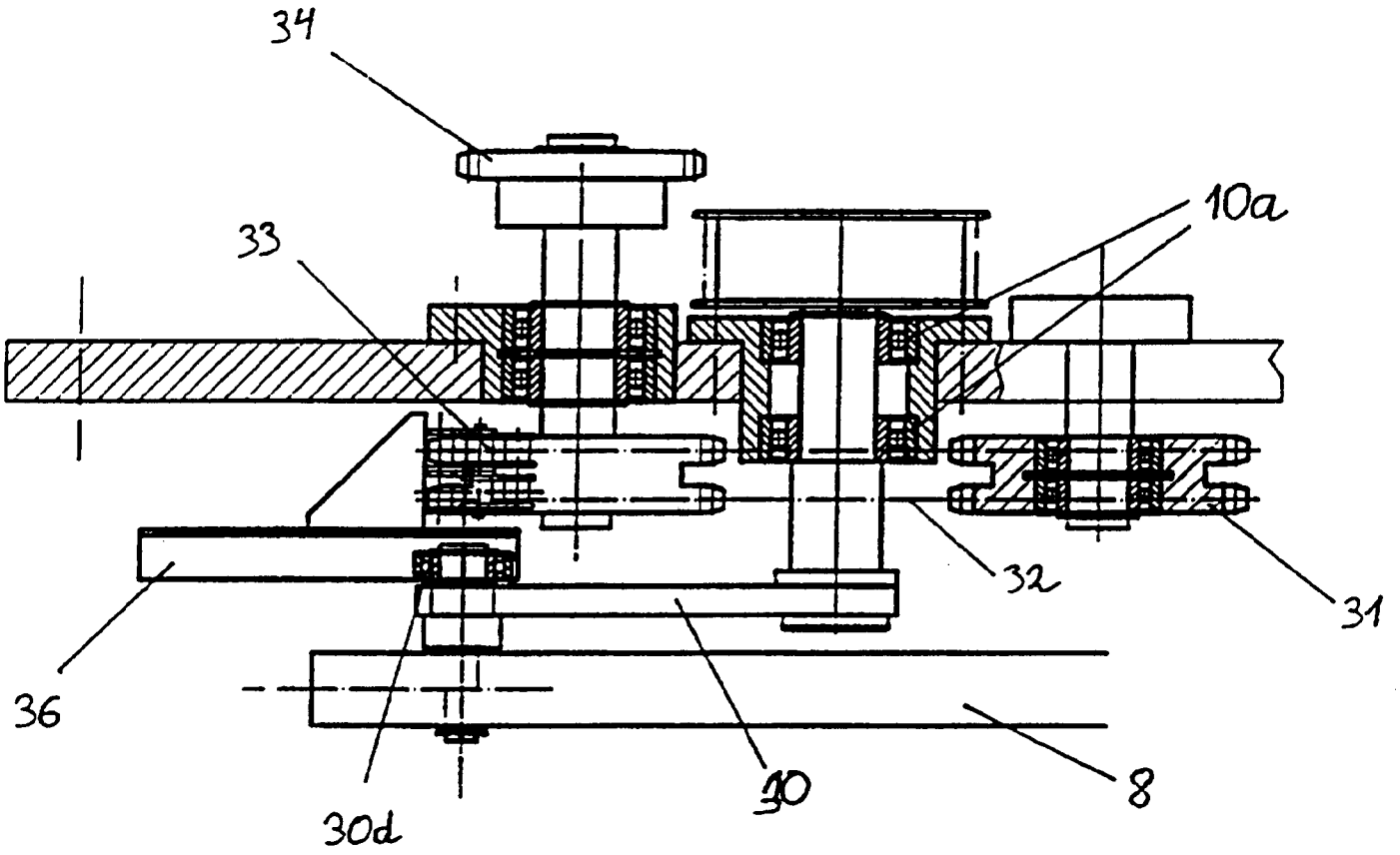
FIGS. 8 and 9 show details of the second embodiment of the device according to the invention.

The linearization of the parallel velocity component vp achieved by the eccentric arrangement of crown gear 16 and the crank 10 driven by it is shown in the graph of FIG. 5. It can be seen that in the range of crank angle $\alpha$ between 45° and 135° good linearization was achieved. Preferably the rotational speed of the crown gear 16 is adjusted in such a way that when $\alpha$=90°, vp is equal to the conveying speed of the material webs, so that there is hardly any slip between the suction cups and the material web.

FIG. 3 shows a carrier plate 19 of the machine body where the rotatable joint 10*a* is fixed. Furthermore, so as to show the rotating arrangement more clearly, FIGS. 1 and 2 show crank 10 with bar 8 at a crank angle a of 90° in full lines and additionally at $\alpha$=45° in phantom lines (see reference numerals 8', 10'). In the same way FIG. 4 shows crank 10 with bar 8 at a crank angle a of 90° in full lines, and additionally in phantom at $\alpha$=135°. Distance a in FIG. 4 is the maximum distance between the center of roller 10 and the center of the driving crown wheel 16 and fulfills the condition a=b+e.

The suction cups 9 on bar 8 may be permanently connected to a vacuum source. It is considered to be more favorable, however, to connect the vacuum source while the suction cups approach the material web a, relatively short time before the suction cups contact the material web, so that the suction cups may suck the material web, and to leave the vacuum source connected while the suction cups again move away from the conveying means of the material webs after they have passed the position closest thereto, pulling the sucked material web along, while at the same time the other material web of the bag body is sucked to conveyor belt. 3. The vacuum source is finally disconnected when the distance between the two material webs is considered to be sufficient. In order to do so, the crank disk 13 is provided with a through hole 13*a* parallel to the axis in the position where it is connected to the rotatable joint 13*b*, which hole extends into the rotatable joint 13*b*, the vacuum channel 8*a* of the bar 8 communicating with this through hole. A vacuum bar 20, which is mounted so as to be stationary, is vacuum-tightly contiguous to the opposing surface 13*c* of crank disk 13, the vacuum bar having a mouth opening 20*a* taking the form of a circular arc and facing towards the disk surface, which coincides with the circular path described by the mouth of the through hole (13*e*) when turning the disk 13. The mouth opening 20*a* communicates with a connecting sleeve 20*b* to which a vacuum source (not shown) may be connected. Thus the vacuum channel 8*a* of bar 10 is only connected to the vacuum source over a clearly defined angular range of crank disk rotation.

In FIGS. 6 to 9, a further embodiment of the device according to the invention is illustrated. The only difference between this embodiment and the first one is a different drive means by which crank 30 (corresponding to crank 10 of the first embodiment) is driven. Thus like reference numerals are used to designate like components of the device, and reference is made to the above description and a repeated detailed explanation omitted.

Figure 9:
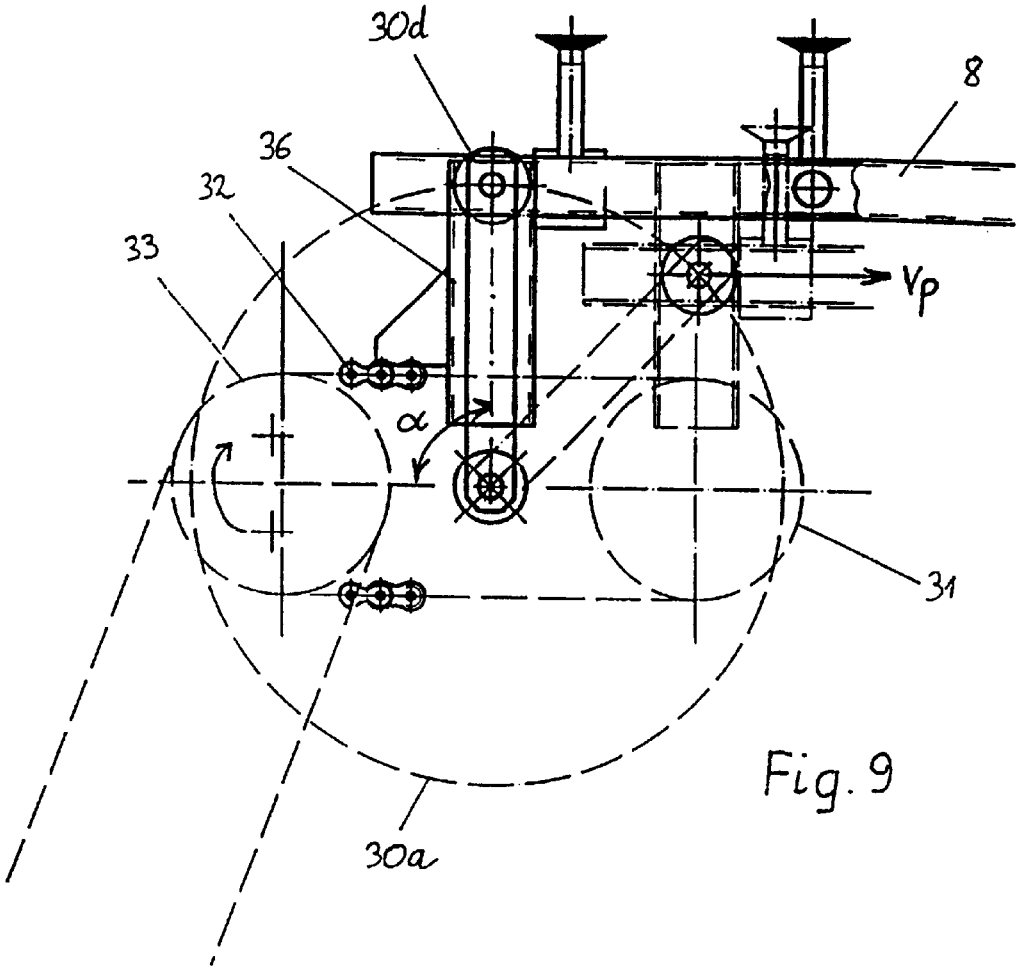

The drive means of the second embodiment no longer is an eccentric disk, but it comprises two twin-gears 31, 33 encircled by a double chain 32. The rotational axis of twin gear 33 is rigidly connected to an additional gear wheel 34, which is driven by the pinion of a motor (not shown) via a chain 35. An engagement element 36 is attached to the double chain 32 so as to move along therewith, which element consists of a U-beam, the longitudinal axis of which is at right angles with to the double chain 32. The legs of this U-beam define a channel wherein a roller 30*d*, which is mounted at the end of crank 30 as its engagement element, is received slidingly. The orbital path of roller 30*d* when rotating crank 30 is shown at 30*a*. Between the twin-gears 31, 33, double chain 32 forms one run each in parallel with the conveying direction of the material paths on both sides, the double chain being driven at such a speed that the engagement element 36 moves at the same speed in a parallel run as the material webs move on conveyor belt 1. With particular reference to FIG. 9, it can be seen that the engagement element 36 reaches the beginning of the first parallel double-chain run when the crank angle $\alpha$ is about 45°. At this point in time the engagement element has made half its way around the twin-gear 33. From this point on, crank 30, the roller 30*d* of which engages the engagement element 36, is driven at a velocity component vp in parallel to the conveying direction of the material web, which component exactly corresponds to the conveying speed. This parallel velocity component is maintained until the engagement element reaches the twin-gear 31, i.e. the end of the parallel double chain run. At this point in time crank 30 has a crank angle of about 135°. From this point on, engagement element 36 changes from a translational movement to a rotational movement around the twin-gear 31, which changes the amount and finally also the sign of the parallel velocity component of crank 30, to which the modified movement of the engagement element is transmitted.

Figure 10:
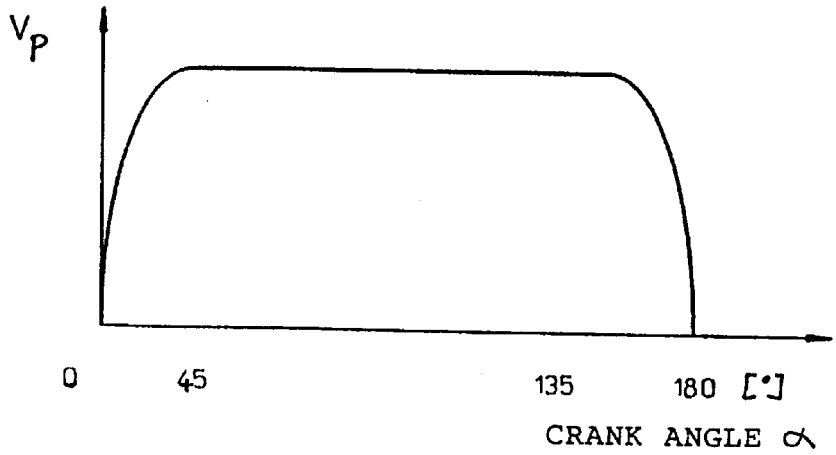
FIG. 10 is a graph of the course of the parallel velocity component of the rotating suction means of the inventive device versus the crank angle.

The graph of FIG. 10 shows that complete linearization of the parallel velocity component vp, which bar 8 experiences, has been achieved by parallel guiding of the engagement element over a crank angle range from 45° to 135°.

What is claimed is:

1. A device for separating two material webs lying on top of each other while the material webs arm being transported on a conveying means, a first one of the two material webs being detachably fixed to the conveying means, the device comprising a suction device movable with respect to a second one of the two material webs for temporarily sucking the second material web and separating it from the first material web;

two cranks spaced apart from each other, each crank having a first rotatable joint for rotating the crank and a second rotatable joint to which the suction device is rotatably connected, one of the two cranks having a first engagement element formed thereon, the distance between the first rotatable joint and the second rotatable joint of each crank being substantially equal and the distance between the first rotatable joints of the two cranks being substantially equal to the distance between the second rotatable joints of the two cranks, so that the rotatable joints define the corners of a parallelogram; and a drive including:

at least two wheels, at least one of which is driven; and a chain or belt encircling the at least two wheels, the chain or belt having a second engagement element displaceably engaging the first engagement element, the first and second engagement elements having respective orbit paths that do not coincide and are not parallel.

2. The device according to claim 1, wherein at least one of the cranks is a crank disk.

3. The device according to claim 1, wherein at least one of the cranks is a crank arm.

4. The device according to claim 1, wherein one of the first and second engagement elements comprises a cam, and the other of the first and second engagement elements comprises a slot, an oblong hole, a channel, at least one guiding rail, or a guide plate.

5. The device according to claim 1, wherein the suction device communicates with a vacuum source.

6. The device of claim 5, wherein the communication between the suction device and the vacuum source is interruptible as a function of the angular position of one of the cranks connected to the suction device.

7. The device according to claim 5, wherein a supply pipe of the suction device is vacuum-tightly connected to a through hole in a disk, the device further comprising:

a stationary vacuum bar connected to the vacuum source and substantially vacuum-tightly contiguous with the opposing surface of the disk, the vacuum bar having a mouth opening taking the form of a circular arc and facing towards the disk surface, the mouth opening coinciding with the circular path described by the through hole when the disk is rotated.

8. The device of claim 7, wherein the disk is a crank disk.

9. The device according to claim 1, wherein the suction device comprises a bar having an internal channel connectable to a vacuum source and a plurality of exit openings extending therefrom.

10. The device of claim 9, wherein a plurality of suction cups are connected to the plurality of exit openings.

11. The device according to claim 1, wherein the two cranks are connected to each other for synchronous movement by a belt or chain gear.

12. The device according to claim 1, wherein the chain or belt has a run substantially parallel to a conveying direction of the material webs and the speed of chain or belt is substantially equal to a conveying speed of the material webs.

13. The device according to claim 1, wherein the second engagement element has a channel at right angles to the chain or belt, which channel is engaged by a cam or roller of a crank.

14. The device of claim 1, wherein the first and second webs are portions of bag bodies.

* * * * *